US006618899B1

(12) United States Patent
Ginzel et al.

(10) Patent No.: US 6,618,899 B1
(45) Date of Patent: Sep. 16, 2003

(54) DOOR CLOSER AND METHOD OF PRODUCING A DOOR CLOSER

(75) Inventors: Lothar Ginzel, Schwerte (DE); Horst Tillmann, Ennepetal (DE); Günter Gollnick, Breckerfeld (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/637,282

(22) Filed: Aug. 11, 2000

Related U.S. Application Data

(63) Continuation-in-part of application No. PCT/EP99/09538, filed on Dec. 6, 1999.

(30) Foreign Application Priority Data

Dec. 14, 1998 (DE) ..... 198 57 297

(51) Int. Cl.[7] ..... E05F 3/00
(52) U.S. Cl. ..... 16/62; 16/51; 16/79
(58) Field of Search ..... 16/62, 52, 53, 16/55, 58, 71, 79

(56) References Cited

U.S. PATENT DOCUMENTS

| | | | | |
|---|---|---|---|---|
| 3,057,004 A | | 10/1962 | Sogoian | |
| 3,571,989 A | | 3/1971 | Gaysowski | |
| 4,019,220 A | | 4/1977 | Lieberman | |
| 4,449,702 A | | 5/1984 | Hasegawa | |
| 4,573,238 A | * | 3/1986 | Phillips | 16/79 |
| 4,707,882 A | * | 11/1987 | Watts | 16/66 |
| 4,744,125 A | | 5/1988 | Scheck et al. | |
| 5,090,089 A | * | 2/1992 | Schulte et al. | 16/51 |
| 5,417,013 A | * | 5/1995 | Tillmann | 16/53 |
| 5,535,514 A | * | 7/1996 | Lucas | 16/62 |
| 5,832,561 A | * | 11/1998 | Bienek | 16/53 |
| 5,943,736 A | * | 8/1999 | Karkkainen et al. | 16/79 |

FOREIGN PATENT DOCUMENTS

| | | |
|---|---|---|
| CH | 281690 | 3/1952 |
| DE | 1039886 | 9/1958 |
| DE | 3545314 | 7/1987 |
| DE | 3645315 | 10/1987 |
| DE | 4002889 | 8/1991 |
| DE | 9413039 | 5/1995 |
| DE | 19540793 | 5/1997 |
| DE | 19822498 | 2/1999 |
| GB | 2292182 | 2/1996 |

* cited by examiner

*Primary Examiner*—Chuck Y. Mah
(74) *Attorney, Agent, or Firm*—Nils H. Ljungman & Associates

(57) ABSTRACT

A door closer assembly and method of making the assembly, in which the closing force is exerted by at least one closing spring. The door closer assembly comprises a housing, a rotor journalled in said housing to deliver torque, and at least one piston apparatus, wherein said housing, said rotor, and said at least one piston apparatus are comprised of the same material of construction and exhibit at least substantially the same thermal expansion coefficient.

20 Claims, 7 Drawing Sheets

FIG. 3
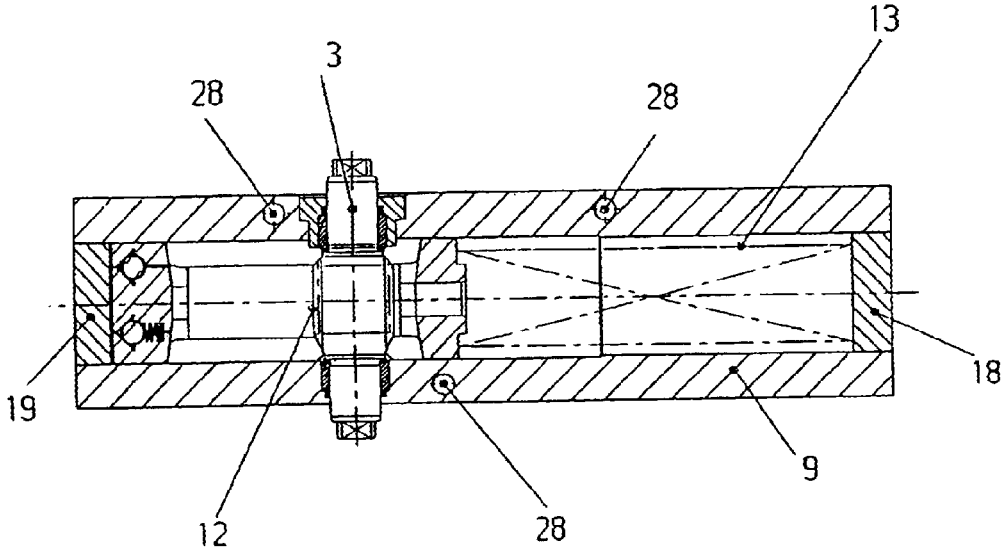
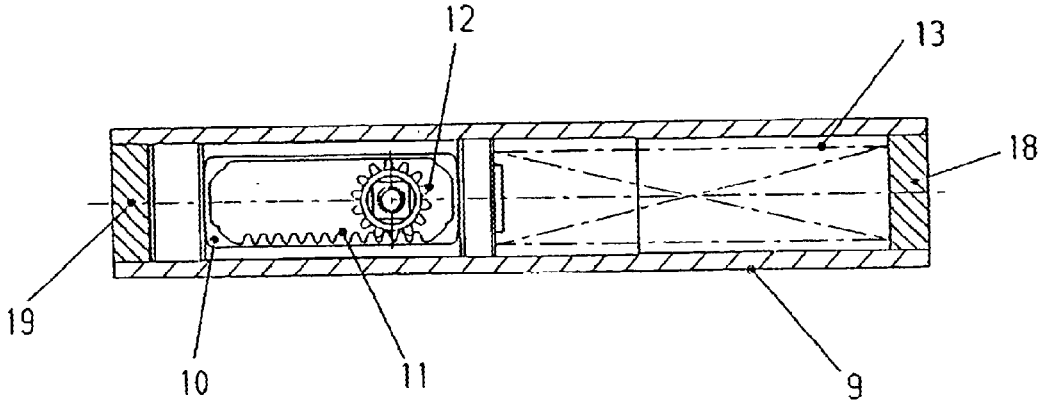
FIG. 4

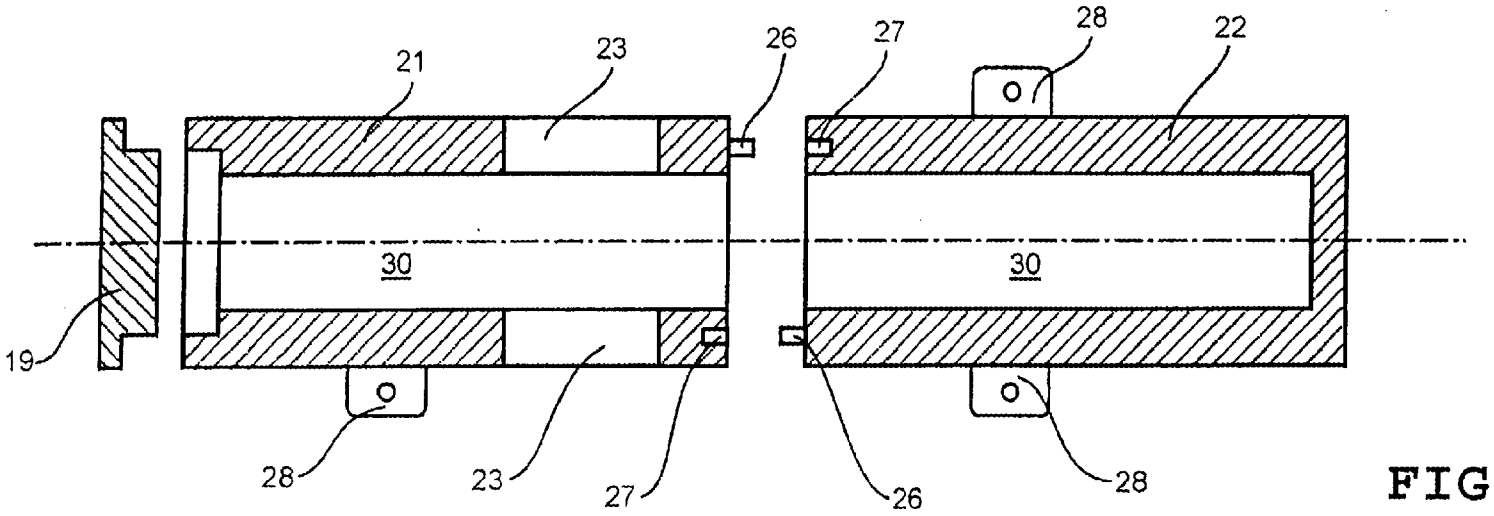
FIG. 5
Fig. 5
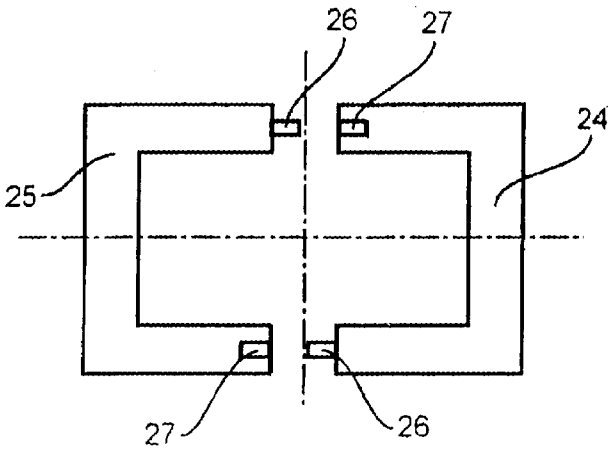
FIG. 6

DOOR CLOSER AND METHOD OF PRODUCING A DOOR CLOSER

CONTINUING APPLICATION DATA

This application is a Continuation-in-Part application of International Application No. PCT/EP99/09538, filed on Dec. 6, 1999 and claiming priority from Federal Republic of Germany Patent Application No. DE 198 57 297.2, filed on Dec. 14, 1998. International Application No. PCT/EP99/09538 was pending as of the filing date of the above-cited application. The United States was an elected state in International Application No. PCT/EP99/09538.

BACKGROUND OF THE INVENTION

1. Field of the Invention

This invention relates to a door closer.

More particularly, this invention relates to a door closer in which on one hand there is a drive cam disk which is positively and non-positively connected with an output shaft that projects out of a housing that is filled with damping medium, whereby the drive cam disk, viewed in the axial direction of the door closer, is in contact on one hand on each side with a pressure roller, and on the other hand with a spring piston which is pressurized by a closing spring, and is also actively connected with a damping piston.

In other words, there is provided a door closer assembly in which the closing force is exerted by at least one closing spring. The door closer assembly generally comprises a walled housing adapted to be filled with a damping medium, a rotor, journalled for rotation in said housing, with the rotor being configured with at least one output shaft formation which is configured to extend an effective distance from the housing and the rotor also comprising a cam disc formation which is positively and non-positively connected with the output shaft formation that projects out of the housing. There is also included a first piston apparatus slidingly disposed in the housing, a first pressure roller mounted between the rotor and the first piston apparatus adjacent the cam disc formation for rotation in conformity with the rotation of the cam disc formation of the rotor to thereby slidingly displace the first piston apparatus in conformity with the motion of the cam disk formation. There is also provided a second piston apparatus slidingly disposed in the housing and configured to be pressurized by the closing spring, and a second pressure roller mounted between the rotor and the second piston apparatus for rotation in conformity with the rotation of the cam disc formation of the rotor to thereby slidingly displace the second piston apparatus in conformity with the motion of the cam disc formation.

In accordance with one feature of the invention at least one of the first and second piston apparatus is disposed in the housing adjacent to the rotor to provide at least two chambers for receiving damping fluid in the housing, with suitable valve devices being part of the piston apparatus.

Thus, at least one of the first and second piston apparatus is configured to provide flow of damping medium between the first and second chambers of the housing.

In accordance with one feature of the invention the housing, the rotor, the first and second piston apparatus, and the first and second pressure rollers are made of the same material of construction and exhibit at least substantially the same thermal expansion coefficient.

The piston and the housing can be made of an oil-tight material of construction, such as plastic.

The invention also relates to a door closer with a plastic piston that has an internal gearing, which plastic piston is driven by means of a pinion that is fastened positively and non-positively on an output shaft, whereby the output shaft projects at least on one side out of a housing that encloses the piston and a closing spring.

The invention further relates to the method of substantially automatically shaping the component structures of a door closer assembly.

2. Background Information

Door closers are well known in the art.

A generic door closer that represents the known art in one aspect is disclosed by Swiss Patent No. 281,690, hereby incorporated as by reference as if set forth in its entirety herein, wherein the drive cam disk, viewed in the axial direction of the door closer, is in contact on each side with a pressure roller. The door closer described in Swiss Patent No. 281,690, hereby incorporated by reference as if set forth in its entirety herein, can be used for DIN (German Industrial Standard) left-hand doors and DIN (German Industrial Standard) right-hand doors, whereby an output shaft is equipped with a symmetrically realized cam disk, which is in contact with the piston and thus with the closing spring. Both the housing and the piston are made of an oil-tight plastic.

A generic door closer that represents the known art in another aspect is disclosed in German Utility Model No. G 94 13 039 U1, hereby incorporated by reference as if set forth in its entirety herein, which describes a door closer which reproduces the internal gearing in a piston. In this case, the gearing and the piston are realized in the form of separate components, whereby the gearing is preferably made of a material other than plastic, namely of a material other than the material of which the piston is made. Likewise, at least portions of the pinion that is engaged with the gearing are made partly of metal and plastic.

German Patent No. 40 02 889 A1, hereby incorporated by reference as if set forth in its entirety herein, describes a door closer, the housing of which is realized in the form of a profile with a hollow chamber. This hollow chamber profile is realized in one piece and consists of an extruded profile which is made of an aluminum alloy or plastic.

A damping piston which is composed of a solid body and an elastic elastomer or plastic body connected with said solid body is described in German Laid Open Patent Publication No. DE-AS 10 39 886, hereby incorporated by reference as if set forth in its entirety herein.

A piston that consists of external gearing in the form of an inserted toothed rack or toothed rod which is made of metal or plastic is described in U.S. Pat. No. 4,019,220, hereby incorporated by reference as if set forth in its entirety herein.

OBJECT OF THE INVENTION

The object of the of the invention is to manufacture a lightweight, economical door closer, in which the machining that is otherwise necessary can be eliminated.

SUMMARY OF THE INVENTION

The present invention teaches that this object can be accomplished by a door closer and method of making a door closer as specified hereinbelow and in the appended claims.

To reduce costs, the invention teaches that, in addition to the parts that the known art discloses can be made of plastic, all the parts requiring intensive machining are made of plastic. These parts include in particular the damping piston, the spring piston and the housing, the drive cam disk, the output shaft and/or the pressure rollers that interact with the drive cam disk. The invention also teaches that the parts located outside the door closer, such as a pantograph-type linkage or actuator arm on a slide rail door closer in connection with the glide rail, all be made out of plastic. It does not matter whether the door closer in question is a floor-mounted door closer, frame-mounted door closer or an internal door closer, i.e., a door closer secured to the inner face of the door, for example.

The cylinder walls that surround the piston are generally round. The reason for this shape is related in particular to the finishing and machining operations that can thereby be eliminated, because the round shape is the easiest to manufacture. However, if the objective is to manufacture a small, economical door closer, i.e., a door closer that does not take up a great deal of space, or in other words, is not required to absorb heavy loads, the cross section of the piston, i.e., of the damping piston and of the spring piston and/or the plastic piston with gearing, can have a cross section other than a round one, namely an oval, rectangular, square or quadrangular cross section. All these shapes can easily be fabricated in plastic, because the housings and/or pistons are manufactured using injection molding processes. On the basis of the characteristics of the plastics currently available, these processes have an enormous dimensional tolerance and thus guarantee an exact fit.

For example, it is possible to manufacture, at no extra cost, door closers as disclosed in German Patent No. 35 45 314 C2 and in German Patent No. 36 45 315 C2 out of plastic, in which the teeth of the piston gearing have different sizes and a different modulus. The matching gearing on the output shaft which is engaged with this gearing can also be easily made of plastic.

A housing of the type described above, on account of the geometric cross sections, need not necessarily be manufactured in one piece using the injection molding process. The housing can also be manufactured from a plurality of segments or partial segments. These segments or partial segments are assembled or combined by means of molded tabs or lugs and corresponding depressions in the matching or mating part, and are positively or non-positively permanently connected together by appropriate methods such as gluing, ultrasonic welding, laser welding or similar processes. As a result of these methods, the dimensional stability of the individual segments is preserved. At the same time, when the housing is realized in the form of individual segments, it is also possible to create channels, borings, pockets, valve seats or even valves themselves directly in the manufacturing process without the need for finishing processes, which reduces the time and effort and thus the cost of manufacture.

Conventionally, the ends of door closers are closed by caps or closures, and depending on the manner in which the segment is manufactured, the invention teaches that these caps or closures are no longer absolutely necessary, because as a result of the joining of the individual segments that are closed on one side, it is altogether conceivable that some of the parts can be pre-assembled. On segments that can be closed only after the assembly has been completed, it is then possible to install separate closures. These closures can also be positively and non-positively connected with the segments or with the housing by gluing, ultrasonic welding or similar methods. In addition to butt joints, the closures can also be provided with grooves, undercuts or bayonet joints to reduce the assembly time required.

On an injection molded realization made of plastic, the fastening devices in the form of corresponding borings to install the assembled door closer in its intended final location can also be molded using non-cutting methods.

The above-discussed embodiments of the present invention will be described further hereinbelow with reference to the accompanying figures. When the word "invention" is used in this specification, the word "invention" includes "inventions", that is, the plural of "invention". By stating "invention", Applicants do not in any way admit that the present application does not include more than one patentably and non-obviously distinct invention, and maintain that this application may include more than one patentably and non-obviously distinct invention. Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiments that are illustrated schematically in the accompanying drawings, wherein:

FIG. 3 is a section through a top-mounted door closer shown in front view with internal gearing;

FIG. 4 is a section through a top plan view of a top-mounted door closer as shown in FIG. 3;

FIG. 5 is a section through a housing of a door closer which consists of individual segments;

FIG. 6 is a side view of two housing halves consisting of two housing segments with a square cross section of the piston chamber;

DESCRIPTION OF THE PREFERRED EMBODIMENTS

In addition to the description of the various exemplary embodiments that follows, which are based on a top-mounted door closer, the teaching of the invention also applies to floor-mounted door closers, frame-mounted door closers and internal door closers such as concealed door closers or door closers secured to the interior face of the door, for example.

With top-mounted door closers, frame-mounted door closers and internally mounted door closers, it is possible to use both a linkage in the form of a scissors-type linkage or an actuator arm in connection with a slide rail. These parts, the slide rail, actuator arm and scissors-type linkage, can also be manufactured from a plastic that has an appropriate strength.

Figure 1:
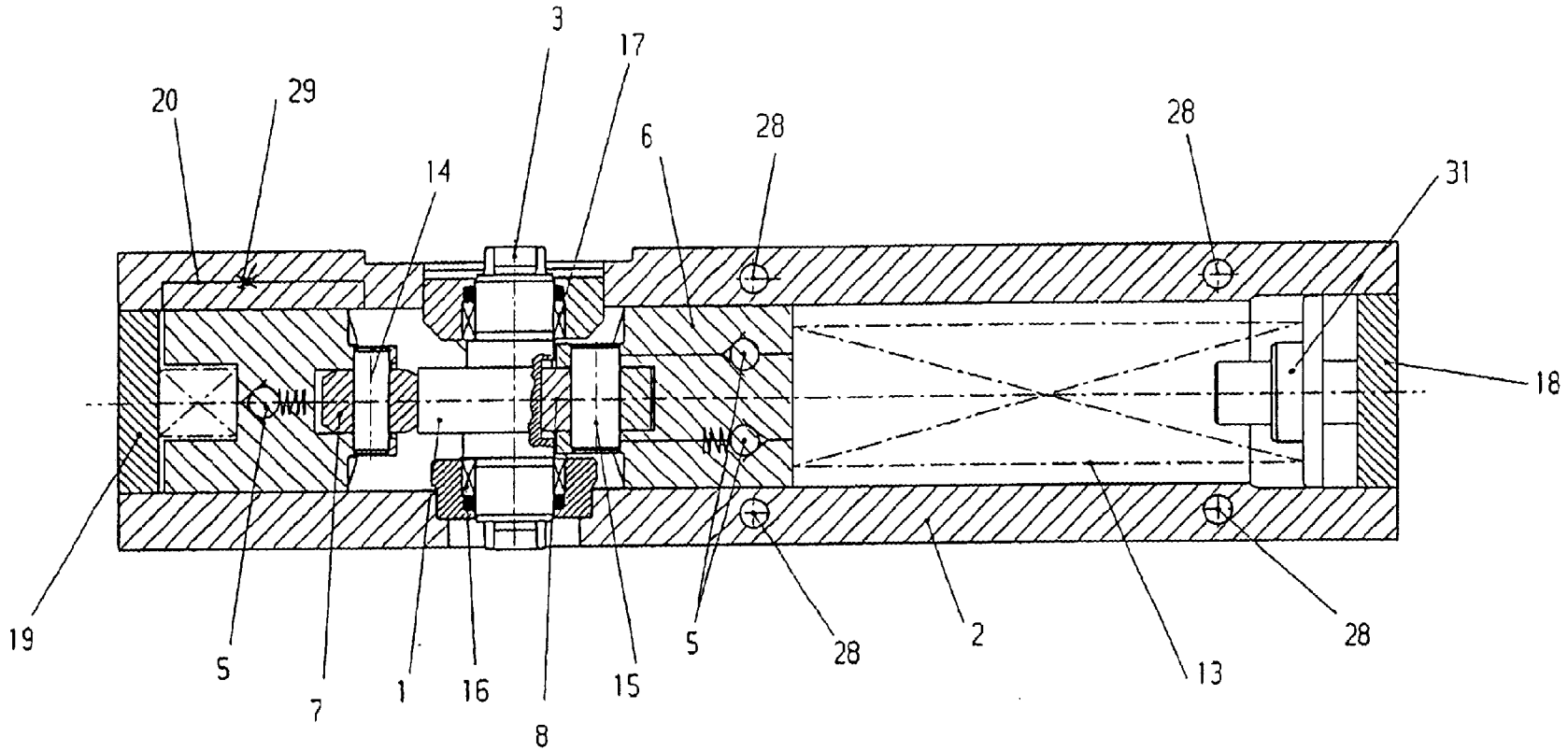
FIG. 1 is an axial section through a side view of a top-mounted door closer with a drive cam disk.
Figure 2:
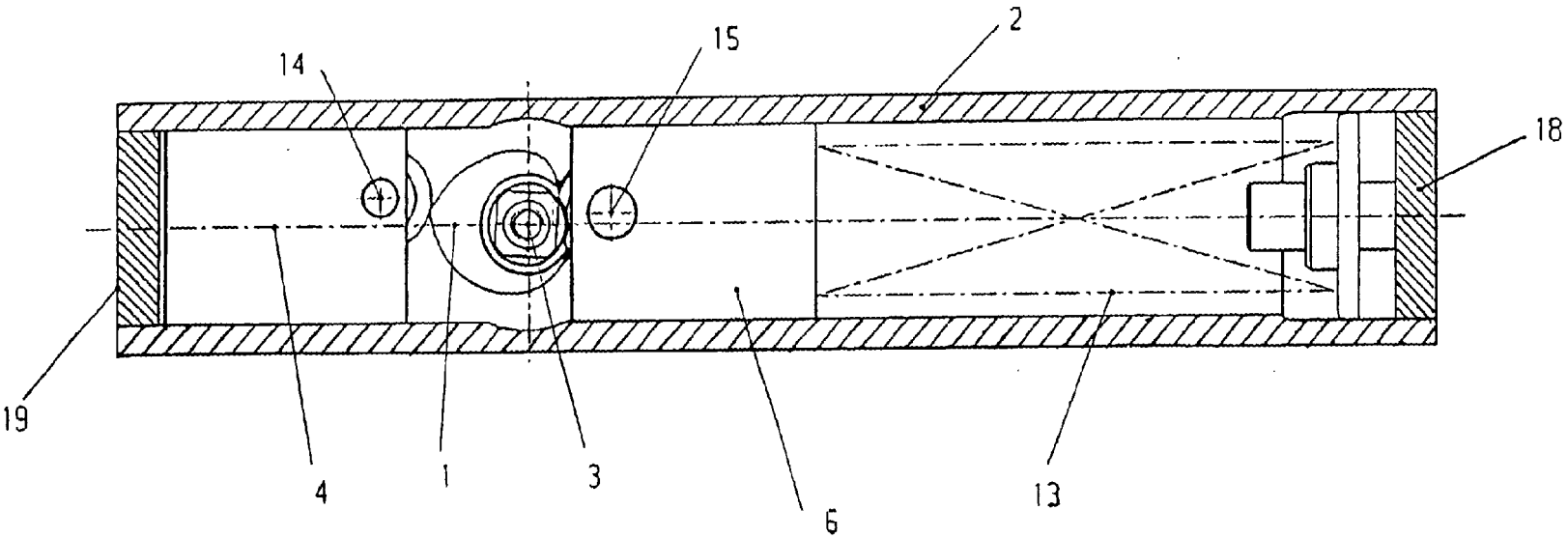
FIG. 2 is an axial section through a top plan view of a top-mounted door closer as shown in FIG. 1.

The door closer illustrated in FIGS. 1 and 2 has a drive cam disk 1, through which an output shaft 3 runs. The output shaft 3 is mounted in the upper portion by an output shaft bearing 17 and in the lower portion by an output shaft bearing 16 inside a housing 2. The bearing thereby consists either of a sintered material or a needle bearing or ball bearing. The output shaft bearings 16 and 17 can, like the housing 2, also be made of plastic. The trajectories of the drive cam disk 1 come into contact on the one side with a pressure roller 7 which is mounted by means of a shaft 14 inside a damping piston 4. On the other side, the drive cam disk 1 is in contact with a pressure roller 8 which is mounted by means of a shaft 15 inside a spring piston 6. On the other end of the spring piston 6, a closing spring 13 is in contact on one end, and on the other end is in contact with a spring counter-plate 31. The lateral ends of the housing 2 are closed by caps 18 or 19 which are connected positively and non-positively with the housing 2 either by gluing, ultrasonic welding, laser welding or similar methods. Because corresponding channels 20 and valves 29 are necessary for the control function of a door closer, these channels and valves are molded into the housing 2 using non-cutting methods. During the process of fabricating the damping piston 4, check valves 5 are simultaneously molded both inside the damping piston 4 and also in the spring piston 6. It is also possible, however, to manufacture these check valves 5 separately, in which case they are also made entirely of plastic.

To fasten a housing 2 of the type described above to a door or above a door, a fastening device 28 is simultaneously molded in or on the housing 2 during the manufacturing process using non-cutting methods.

It goes without saying that when the parts are molded out of plastic without subsequent machining, in addition to the bore through the cylinder or, in other words, the continuous bore in housing 2 for the damping piston 4, the spring piston 6 and the closing spring 13, which in the known art are round, can also be manufactured in other shapes. These other possible shapes include in particular an oval shape, which would simultaneously mean that the dimensions of the closer would be significantly narrower than a closer with a rectangular or square shape.

FIG. 2, which shows a one-piece housing, clearly shows that as a result of the use of the same materials for the damping piston 4 and the spring piston 6 and the drive cam disk 1 with the output shaft 3, no problems related to thermal expansion can occur when the door closer is heated, for example, by solar radiation, because the material used for all the components has the same coefficient of thermal expansion. This advantage represents an advance over the known art, because when steel or aluminum, for example, is used in connection with plastic, these materials have very different coefficients of thermal expansion, which in some cases may necessarily result in leaks or failures of such a door.

FIGS. 3 and 4 illustrate an additional exemplary embodiment of a toothed rack door closer with a piston 10, which is made of plastic and has internal gearing 11. Effectively connected with the gearing 11 is a pinion 12, whereby the pinion 12 is positively and non-positively attached to the output shaft 3. In this exemplary embodiment, in addition to the housing 9, the piston 10 with its gearing 11 and the output shaft 3 with its pinion 12 are also made of plastic. Thus, the door closer has the same characteristics as the one illustrated in FIGS. 1 and 2, i.e., the heating of this door closer would also have no effect on its function because all the parts have the same coefficient of thermal expansion. The ends of the housing 9 are also closed by caps 18 and 19, which are also connected with the housing 9 by gluing, ultrasonic welding, laser welding or similar positive and non-positive methods.

When the door closer is a floor-mounted model made entirely of plastic, naturally the cement casing that is part of the floor-mounted door closer may also be made of plastic.

The exemplary embodiment illustrated in FIG. 5 shows the housing of a door closer which is composed of different segments 21 and 22. It is thereby possible to realize the different segments individually and by using different methods, such as, for example, the segment 22, which is shown as a segment which is open on one side with molded-on fasteners 28. At the points to be connected, the segments 21 and 22 have lugs or tabs 26 and depressions 27 which, when the part is assembled, engage one another and during the subsequent process of connecting the segments create a positive and non-positive connection and also a dimensionally stable shape. The piston chamber 30, which is inside the segments 21 and 22, is closed on the open side of the segments 21 by a cap 19. In the segment 21 there is also a boring 23 for the output shaft bearings 16 and 17 shown in FIG. 1, which is also molded at the same time using non-cutting and non-material removing methods.

In addition to the division of the segments 21 and 22, it is also possible to divide the segments in other ways, as illustrated in FIG. 6. FIG. 6 shows segments 24 and 25, which are connected with each other in the longitudinal direction of the door closer by means of lugs or tabs 26 and depressions 27. FIG. 6 also shows the piston chamber 30, which, in this exemplary embodiment, is in the shape of a square piston chamber.

In the exemplary embodiments described above, which do not claim to be a complete enumeration of possible variants, it is assumed that the door closers in question can be of any type, which are assembled without subsequent machining or finishing of the individual parts and segments. Such an assembly can also be performed using an automatic process. The parts manufactured out of plastic, preferably using an injection molding method, are positively and non-positively connected without any subsequent finishing or machining by gluing, ultrasonic welding, laser welding or similar methods. The plastic used can be a plastic material that is reinforced with carbon fiber or glass.

Figure 7:
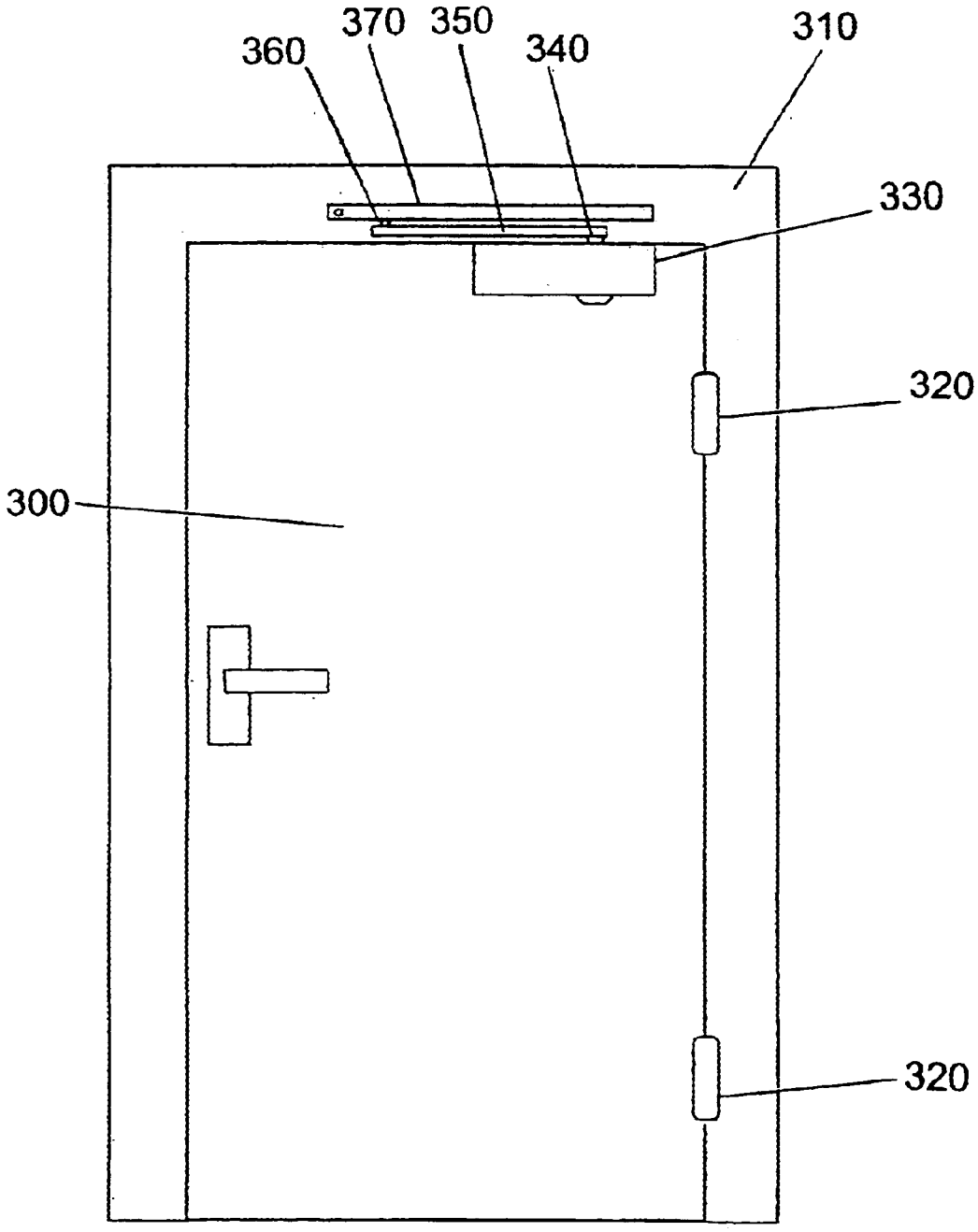
FIG. 7 is an elevation of a door with a top-mounted door closer.

FIG. 7 is a copy of the FIG. 1 from German Laid Open Patent Publication No. DOS DE 198 22 498 A1, having the German title "Tuerantrieb", having the inventors Feucht et al., filed in Germany on May 19, 1998, and laid open on Feb. 4, 1999, from which figure copy all of the reference numerals present in the original figure, as it appears in German Laid Open Patent Publication No. DOS DE 198 22 498 A1 have been removed. German Laid Open Patent Publication No. DOS DE 198 22 498 A1 is hereby incorporated by reference as if set forth in its entirety herein. The reference numerals that have been removed from the figure for this German Patent Publication, essentially reproduced herein as FIG. 7, indicate arrangements that are well known in art.

In one possible embodiment of the present invention, illustrated in FIG. 7 the present invention is shown with a door 300 mounted by a door frame 310 by way of hinges 320. A door closer 330, of the type as described hereinabove and below, is linked by an output shaft 340 to an actuator arm or linkage arm 350 which, in turn, is slidingly engaged by way of a roller or the like, generally identified by reference numeral 360, in the slide rail 370.

Figure 8:
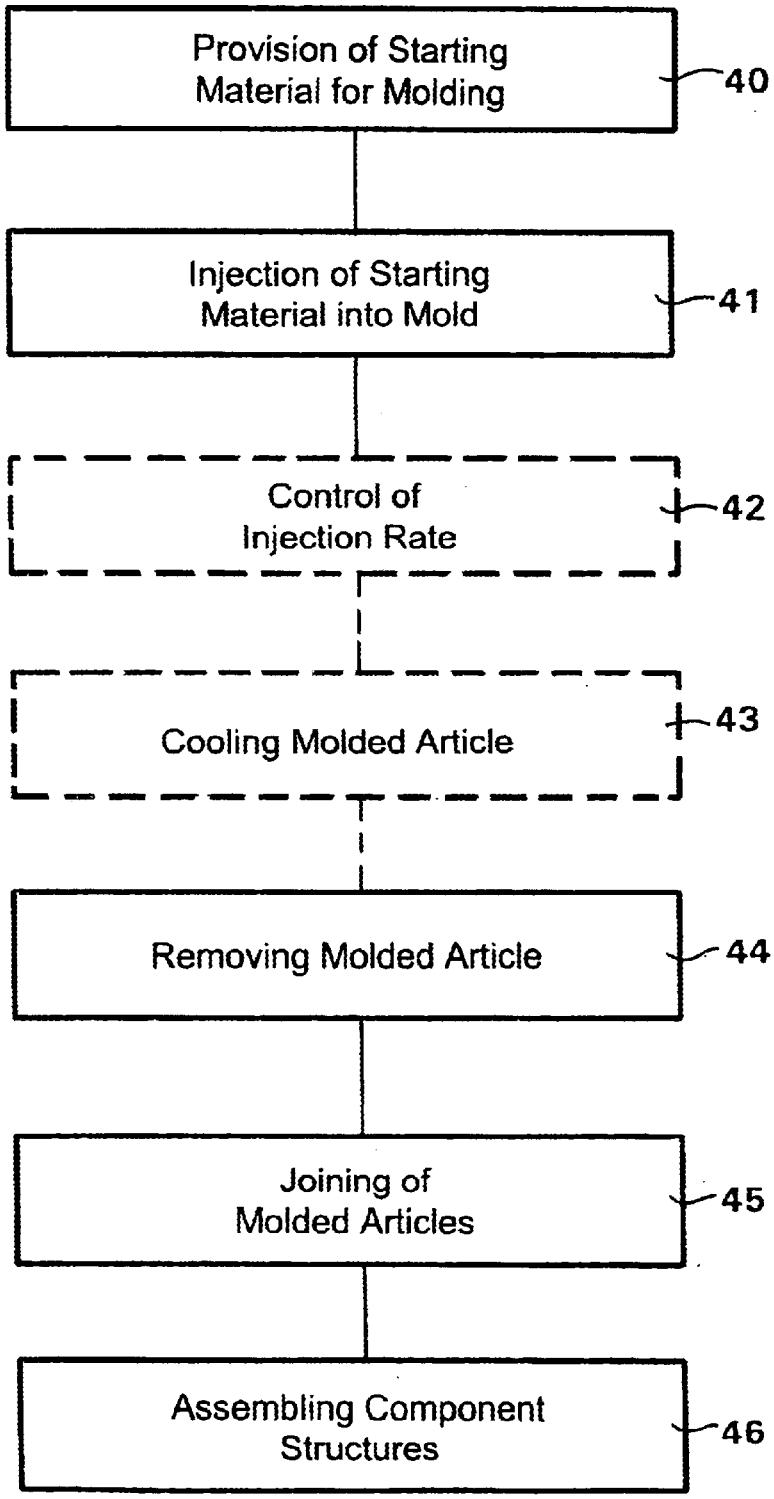
FIG. 8 is a block flow diagram of a method of injection molding and assembly of a door closer from component parts in accordance with one aspect of the invention.

With reference to FIG. 8, there is shown a block diagram showing the preparation 40 of material to be molded, injection 41 of the starting material into an injection molding apparatus. The desired shape of the component structure of the door assembly is then molded, which may involve control 42 of the injection rate and cooling 43. The item is then removed 44 from the mold and joined 45 as required to another component part of the door closer, as mentioned hereinabove and below. The individual components obtained in this manner are then assembled 46 into a door closer assembly.

Figure 9:
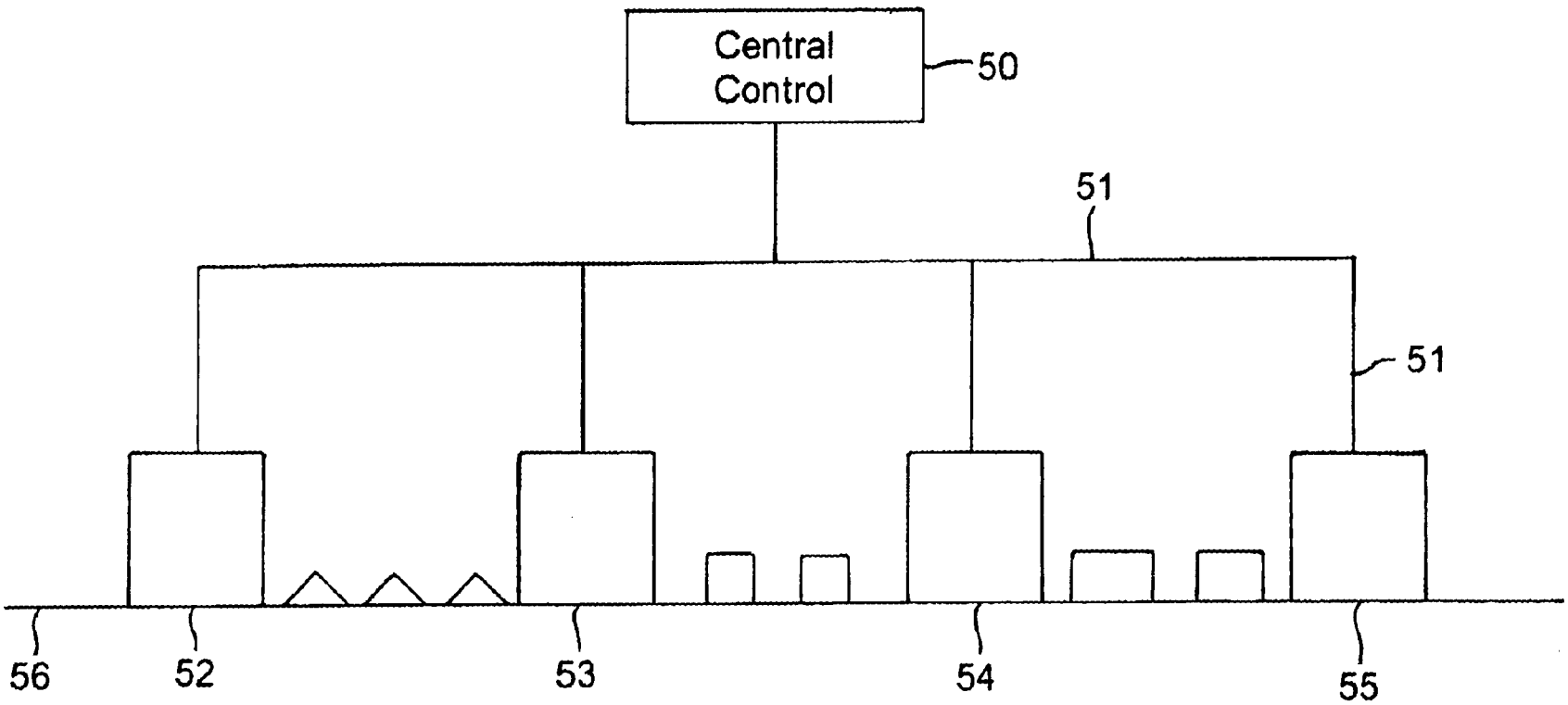
FIG. 9 is a schematic view of an automatic manufacturing scheme for the door closer in accordance with one aspect of the invention.

The automated manufacture of a door closer assembly is outlined schematically in FIG. 9. This automated manufacturing system is subject to a central control 50 which receives data from the individual operating stations and upon processing such data issues data to the individual operating stations. The data flow is indicated by lines 51.

FIG. 9 shows the material preparation operation 52 for preparing material to be molded. The molding is carried out in molding operation 53 and, following molding of the component structures, the components are assembled into a door closer assembly 54. A completed door closer assembly can be passed to a testing/quality control operation 55. The individual operations can be linked by a conveyor, generally identified by reference numeral 56.

In accordance with one embodiment of the invention the material of construction of the major door closer components can be so-called "engineering plastics" and "reinforced engineering plastics". These terms denote, inter alia, high-performance thermoplastic polyesters (for example, polyethylene terephthalates) for industrial applications where rigid engineering specifications must be met.

There are three key characteristics that distinguish engineering resins from other plastics materials: the plastics' mechanical and chemical properties and durability. In specific terms, the following properties are associated with "engineering" resins: (1) high strength/weight ratio, (2) retention of mechanical properties at elevated temperatures, (3) low creep, (4) low coefficients of thermal expansion, (5) good electrical properties, and (6) good chemical resistance.

Some examples of these engineering resins include acetals, nylons (polyamide), polyacetals poly (oxymethylenes)], polyacrylates, polycarbonate, polyethers, polyphenylene oxide, polyphenylene sulfide, polysulfones, and thermoplastic polyesters.

Additionally, reinforced plastics can mean products made from polymers that are reinforced with fibrous reinforcements in the form of discrete fibers, fiber strands, or woven or non-woven fabrics.

KEVLAR is an aromatic polyamide fiber developed by Du Pont.

Composites can mean plastic parts made using epoxy or polyimide resins as a matrix, glass, boron, graphite, or KEVLAR as the reinforcement and processed at pressures below approximately 200 psi or below approximately 200 pounds per square inch.

The terms "non-cutting" and "non-material removing" methods, as well as variants of these terms, are to mean the shaping and/or forming by methods other than chips or the like residues producing operations which include such shaping to final dimensions as by means of a lathe, a milling machine, a drill, and the like, which operations will inherently produce chip-like residues or waste.

The terminology "positively and non-positively connected", as well as variants of this terminology, is to indicate that at least two components are effectively connected to one another in a direct or an indirect manner to function as a uniform structure.

One feature of the invention resides broadly in a door closer which has a drive cam disc which is positively and non-positively connected with an output shaft that projects out of a housing that is filled with damping medium, whereby the drive cam disk, viewed in the axial direction of the door closer, is in contact on each side with a pressure roller, and on the one hand with a spring piston which is pressurized by a closing spring, and on the other hand is actively connected with a damping piston, whereby the piston and the housing are made of an oil-tight plastic characterized by the fact that in addition to the damping piston 4, the spring piston 6 and the housing 2, the drive cam disk 1, the output shaft 3 and/or the pressure rollers 7, 8 are also made of plastic.

Another feature of the invention resides broadly in the door closer with a plastic piston that has internal gearing and is driven by a pinion that is positively and non-positively fastened to an output shaft, whereby the output shaft emerges on at least one side from a housing that surrounds the piston and a closing spring characterized by the fact that the housing 9 is made of plastic.

Yet another feature of the invention resides broadly in the door closer characterized by the fact that the door closer is a floor-mounted door closer or a door closer with a scissors-type linkage or actuator arm in connection with a slide rail or a frame-mounted door closer or an internal door closer, whereby the scissors-type linkage, the actuator arm and the slide rail are made entirely or partly out of plastic.

Still another feature of the invention resides broadly in the door closer characterized by the fact that the damping piston 4, the spring piston 6 and the plastic piston 10 have an oval cross section.

A further feature of the invention resides broadly in the door closer characterized by the fact that the damping piston 4, the spring piston 6 and the plastic piston 10 have a rectangular or square cross section.

Another feature of the invention resides broadly in the door closer characterized by the fact that the internal gearing has teeth of different sizes with different moduli, whereby the matching gearing of a pinion 12 of the output shaft is complementary.

Yet another feature of the invention resides broadly in the door closer characterized by the fact that the housing 2 and 9 consists of segments 21, 22, 24, 25 or partial segments that are connected to one another.

Still another feature of the invention resides broadly in the door closer characterized by the fact that the segments 21, 22, 24, 25 can be assembled or connected to one another by means of molded lugs 26 or projections and matching depressions 27.

A further feature of the invention resides broadly in the door closer characterized by the fact that channels 20, borings, pockets, valve seats, etc. have been directly incorporated or molded into the segments 21, 22, 24, 25 and pistons 4, 6, 10 directly during the manufacturing process, without any subsequent finishing or machining.

Another feature of the invention resides broadly in the door closer characterized by the fact that the housing 2 and 9 is closed on the ends by separate caps 18, 19.

Yet another feature of the invention resides broadly in the door closer characterized by the fact that the housing 2 and 9 and/or the segments 21, 22, 24, 25 have molded fastening devices 28 fabricated using non-cutting methods for the assembly and installation of the door closer.

Still another feature of the invention resides broadly in the door closer characterized by the fact that the plastic used is reinforced with carbon fibers or glass fibers.

A further feature of the invention resides broadly in the door closer characterized by the fact that a check valve 5 is contained in the damping piston 4, the spring piston 6 and/or the plastic piston 10, which check valve is realized directly during the manufacturing process.

Another feature of the invention resides broadly in the door closer characterized by the fact that the segments 21, 22, 24, 25 and caps 18, 19 are connected to one another by gluing, ultrasonic welding, laser welding or similar methods.

Yet another feature of the invention resides broadly in the door closer characterized by the fact that the cement casing that is part of the floor-mounted door closer is made of plastic.

Still another feature of the invention resides broadly in the method for the manufacture of a door closer characterized by the fact that all the parts that are made of plastic are manufactured using a non-cutting process, preferably an injection molding process, and are connected to each other or to one another without subsequent additional finishing or machining by gluing, ultrasonic welding, laser welding or similar methods.

A further feature of the invention resides broadly in the method characterized by the fact that the assembly is accomplished by means of an automatic fabrication process.

Another feature of the invention resides broadly in a door closer assembly in which the closing force is exerted by at least one closing spring, the door closer assembly comprising: a walled housing configured to be filled with a damping medium; a rotor, journalled for rotation in the housing, the rotor being configured with at least one output shaft formation, the at least one output shaft formation extending an effective distance from the housing; and a cam disc formation; at least one actuator arm having torque output from the at least one output shaft formation of the rotor; a first piston apparatus slidingly disposed in the housing; a first.pressure roller mounted between the rotor and the first piston apparatus adjacent the cam disc formation for rotation in conformity with the rotation of the cam disc formation of the rotor to thereby slidingly displace the first piston apparatus in conformity with the motion of the cam disk formation; a second piston apparatus slidingly disposed in the housing and configured to be pressurized by the closing spring; and a second pressure roller mounted between the rotor and second piston apparatus for rotation in conformity with the rotation of the cam disc formation of the rotor to thereby slidingly displace the second piston apparatus in conformity with the motion of the cam disc formation; at least one of: the first piston apparatus and the second piston apparatus being is disposed in the housing adjacent to the rotor to provide at least two chambers for receiving damping fluid in the housing, and at least one of: the first piston apparatus and the second piston apparatus being configured to provide flow of damping medium between the two chambers of the housing; the housing, the rotor, the at least one actuator the first and second piston apparatus, and the first and second pressure rollers are comprised of substantially the same material of construction and exhibit at least substantially the same thermal expansion coefficient.

Yet another feature of the invention resides broadly in a door closer assembly in which the closing force is exerted by at least one closing spring, the door closer assembly comprising: a walled housing; a rotor, journalled in the housing to deliver torque, the rotor being configured with at least one output shaft formation, the at least one output shaft formation projecting an effective distance from the housing; and a driver formation operatively connected with the output shaft formation that projects out of the housing; and at least one piston apparatus slidingly disposed in the housing and configured to translate linear force into torque by interaction with the rotor; the housing, the rotor, and the at least one piston apparatus being comprised of the same material of construction and exhibit at least substantially the same thermal expansion coefficient.

Still another feature of the invention resides broadly in the method of substantially automatically producing a door closer assembly in which the closing force is exerted by at least one closing spring, the method comprising the steps of (a) forming by non-machining at least one component structure of: a walled housing; a rotor, configured to be journalled in the housing to deliver torque when assembled, the rotor being configured with at least one output shaft formation, the at least one output shaft formation projecting an effective distance from the housing; and a driver formation operatively connected with the output shaft formation that projects out of the housing; and at least one piston apparatus configured to be slidingly disposed in the housing when assembled and configured to translate linear force into torque by interaction with the rotor; the housing, the rotor, and the at least one piston apparatus being comprised of the same material of construction and exhibiting at least substantially the same thermal expansion coefficient the forming step producing the component structures in a single step by forming the component-structures to final finished dimensions without machining from the same material of construction to thereby exhibit at least substantially the same thermal expansion coefficient; (b) mounting the closing spring between the at least one piston apparatus and the housing; and (c) assembling the component structures into a door closer assembly.

Examples of apparatus and processes relating to injection molding apparatus, methods and materials, which may be incorporated in an embodiment of the present invention may be found in U.S. Pat. No. 6,090,327 issued on Jul. 18, 2000 and entitled "Method of molding hardenable material"; U.S. Pat. No. 6,060,005 issued on May 9, 2000 and entitled "Low pressure method and apparatus for injection molding a plastic article"; U.S. Pat. No. 6,042,361 issued on Mar. 28, 2000 and entitled "Mold for use in plastic injection molding system and venting pin assembly for use therein"; U.S. Pat. No. 6,022,502 issued on Feb. 8, 2000 and entitled "Composite friction assembly"; U.S. Pat. No. 5,962,376 issued on Oct. 5, 1999 and entitled "Resin composition for sliding member and resin gear"; U.S. Pat. No. 5,895,621 issued on Apr. 20, 1999 and entitled "Method for manufacturing a steering wheel pad"; U.S. Pat. No. 5,853,630 issued on Dec. 29, 1998 and entitled "Low pressure method for injection molding a plastic article"; U.S. Pat. No. 5,766,526 issued on Jun. 16, 1998 and entitled "Method and apparatus for injection molding"; U.S. Pat. No. 5,543,093 issued on Aug. 6, 1996 and entitled "Injection molding method and apparatus"; U.S. Pat. No. 5,451,363 issued on Sep. 19, 1995 and entitled "Injection molding method" U.S. Pat. No. 5,023,041 issued on Jun. 11, 1991 and entitled "Method for making a fiber reinforced composite article"; U.S. Pat. No. 4,960,262 issued on Oct. 2, 1990 and entitled "Ball valve and methods of fabrication"; U.S. Pat. No. 4,820,464 issued on Apr. 11, 1989 and entitled "Method for controlling injection molding machine"; U.S. Pat. No. 4,627,952 issued on Dec. 9, 1986 and entitled "Injection molding process"; and U.S. Pat. No. 4,079,488 issued on Mar. 21, 1978 and entitled "Fan wheel for blower and apparatus for manufacturing same".

Examples of compositions which may be incorporated in an embodiment of the present invention may be found in U.S. Pat. No. 6,037,439 issued on Mar. 14, 2000 and entitled "Process for continuous production of polyacetal resin"; U.S. Pat. No. 6,028,161 issued on Feb. 22, 2000 and entitled "Polycarbonate copolymers and applications thereof"; U.S. Pat. No. RE 36,347 issued on Oct. 19, 1999 and entitled "Impact-resistant polyamide composition"; U.S. Pat. No. 5,912,320 issued on Jun. 15, 1999 and entitled "Polyphenylene sulfide resin composition and resin-encapsulated"; U.S. Pat. No. 5,731,389 issued on Mar. 24, 1998 and entitled "Blends of polyester and polyamides, optionally with polycarbonates"; U.S. Pat. No. 5,506,311 issued on Apr. 9, 1996 and entitled "Polyimides, process for the preparation thereof and polyimide resin compositions"; U.S. Pat. No. 5,281,665 issued on Jan. 25, 1994 and entitled "Thermoplastic resin composition"; U.S. Pat. No. 5,115,004 issued on May 19, 1992 and entitled "Polyester resin molding compositions and molded articles formed of the same"; U.S. Pat. No. 4,955,758 issued on September 11, 1990 and entitled "Reinforcing method and means"; and U.S. Pat. No. 4,665,137 issued on May 12, 1987 and entitled "Crosslinkable difunctionalized poly(phenylene oxide) and process for preparation thereof".

Examples of apparatus and processes relating to ultrasonic welding of plastic articles that may be incorporated in or used for an embodiment of the present invention may be found in U.S. Pat. No. 6,068,901 issued on May 30, 2000 and entitled "Ultrasonic energy directing attachment of plastic parts"; U.S. Pat. No. 5,769,256 issued on Jun. 23, 1998 and entitled "Method and apparatus for securing one plastic member to another plastic member"; U.S. Pat. No. 5,681,409 issued on Oct. 28, 1997 and entitled "Ultrasonic welding of electrical plugs"; U.S. Pat. No. 5,397,408 issued on Mar. 14, 1995 and entitled "Ultrasonic welding of metallized plastic"; and U.S. Pat. No. 4,144,109 issued on Mar. 13, 1979 and entitled "Ultrasonic welding of plastic members".

Examples of apparatus and processes relating to laser welding of plastic articles that may be incorporated in or used for an embodiment of the present invention may be found in U.S. Pat. No. 6,060,681 issued on May 9, 2000 and entitled "Process and apparatus for laser welding"; U.S. Pat. No. 5,951,889 issued on Sep. 14, 1999 and entitled "System and method for laser welding"; U.S. Pat. No. 5,831,239 issued on Nov. 3, 1998 and entitled "Laser welding method"; U.S. Pat. No. 5,662,643 issued on Sep. 2, 1997 and entitled "Laser welding system"; and U.S. Pat. No. 5,616,261 issued on Apr. 1, 1997 and entitled "Laser welding system".

Some examples of electronic control or electronic regulation systems which may be utilized or incorporated in a possible embodiment of the present invention may be found in the following U.S. Pat. No. 5,770,934, issued to inventor Theile on Jun. 23, 1998; U.S. Pat. No. 5,666,268, issued to inventors Rix et al. on Sep. 9, 1997; U.S. Pat. No. 5,625,266, issued to inventor Stark on Apr. 29, 1997; U.S. Pat. No. 5,428,278, issued to inventors Bollengier et al. on Jun. 27, 1995; and U.S. Pat. No. 4,838,052, issued to inventors Williams et al. on Jun. 13, 1989.

Some examples of control systems which measure operating parameters and learn therefrom which may be utilized or incorporated in a possible embodiment of the present invention may be found in the following U.S. Patents: U.S. Pat. No. 5,770,934, issued to inventor Theile on Jun. 23, 1998; U.S. Pat. No. 5,191,272, issued to inventors Torii et al. on Mar. 2, 1993; U.S. Pat. No. 5,223,820, issued to inventors Sutterlin et al. on Jun. 29, 1993; and U.S. Pat. No. 4,655,188, issued to inventors Tomisawa et al. on Apr. 7, 1987.

Some examples of memories which may be utilized or incorporated in a possible embodiment of the present invention may be found in the following U.S. Patents: U.S. Pat. No. 5,789,887, issued to inventor Elischewski on Aug. 4, 1998; U.S. Pat. No. 5,770,934, issued to inventor Theile on Jun. 23, 1998; U.S. Pat. No. 5,453,736, issued to inventor Noren on Sep. 26, 1995; U.S. Pat. No. 5,315,220, issued to inventors Takimoto et al. on May 24, 1994; U.S. Pat. No. 4,994,724, issued to inventor Hsu on Feb. 19, 1991; U.S. Pat. No. 4,498,033, issued to inventors Aihara et al. on Feb. 5, 1985; and U.S. Pat. No. 4,328,540, issued to inventors Matsuoka et al. on May 4, 1983.

Some examples of automated manufacturing which may be utilized or incorporated with embodiments of the present invention may be found in the following U.S. Patents: U.S. Pat. No. 6,094,416 issued Jul. 25, 2000 and entitled "Multi-tier architecture for control network"; U.S. Pat. No. 6,079,940 issued on Jun. 27, 2000 and entitled "Method for removing and transporting articles from molds"; U.S. Pat. No. 6,023,680 issued on Feb. 8, 2000 and entitled "Methods, apparatus and computer program products for automated visual inspection"; U.S. Pat. No. 5,991,528 issued on Nov. 23, 1999 and entitled "Expert manufacturing system"; U.S. Pat. No. 5,980,184 issued on Nov. 9, 1999 and entitled "Apparatus for removing and transporting articles from molds"; U.S. Pat. No. 5,857,192 issued on Jan. 5, 1999 and entitled "Quality control system employing bi-directional messaging using empty files"; U.S. Pat. No. 5,636,144 issued on Jun. 3, 1997 and entitled "Evaluation and ranking of manufacturing line non-numeric information"; U.S. Pat. No. 5,565,980 issued on Oct. 15, 1996 and entitled "Apparatus for the detection of surface defects"; U.S. Pat. No. 5,546,313 issued on Aug. 13, 1996 and entitled "Method and apparatus for producing three-dimensional articles from a computer generated design"; and U.S. Pat. No. 5,513,276 issued on Apr. 30, 1996 and entitled "Apparatus and method for three-dimensional perspective imaging of objects".

The features disclosed in the various publications disclosed or incorporated by reference herein may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications are hereby incorporated by reference as if set forth in their entirety herein as follows: Germany Laid Open Patent Publication DOS DE 195 40 793 A1, inventor Alber; German Laid Open Patent Publication DOS DE 198 22 498 A1, inventor Feucht et al.; German Laid Open Patent Application DOS DE 40 02 889 A1, inventor Alber; U.S. Pat. No. 3,057,004 issued to Sogoian on Oct. 9, 1962; U.S. Pat. No. 3,571,989 issued to Gaysowski on Mar. 23, 1971; U.S. Pat. No. 4,449,702 issued to Hasegawa on May 22, 1984; U.S. Pat. No. 4,744,125 issued to Scheck et al. on May 17, 1988; and UK Patent Application GB 2 292 182 A (corresponding to U.S. Pat. No. 5,535,514), inventor Lucas.

The corresponding foreign and international patent publication applications, namely, Federal Republic of Germany Patent Application No. 198 57 297.2, filed on Dec. 14, 1998, 1996, having inventors Lothar Ginzel, Horst Tillmann, and Günter Gollnick, and DE-OS 198 57 297.2 and DE-PS 198 57 297.2 and International Application No. PCT/EP99/09538, filed on Nov. 29, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein, are hereby incorporated by reference as if set forth in their entirety herein.

The details in the patents, patent applications and publications may be considered to be incorporable, at Applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

This invention as described hereinabove in the context of the preferred embodiments is not to be taken as limited to all of the provided details thereof, since modifications and variations thereof may be made without departing from the spirit and scope of the invention.

What is claimed is:

1. A door closer to close a door, said door closer comprising:

a plastic housing consisting essentially of a plastic material;

a plastic drive cam disk consisting essentially of a plastic material and being rotatably disposed in said plastic housing;

a plastic output shaft consisting essentially of a plastic material and being disposed to project out a distance from said plastic housing;

said plastic drive cam disk being connected to said plastic output shaft to permit transfer of force between said plastic drive cam disk and said plastic output shaft;

said plastic output shaft being configured to be operatively connected to a door to permit transfer of force between said plastic output shaft and a door;

a plastic spring piston consisting essentially of a plastic material and being slidingly disposed in said plastic housing;

a first plastic pressure roller consisting essentially of a plastic material and being disposed between said plastic drive cam disk and said plastic spring piston;

said first plastic pressure roller being configured and disposed to rotate upon rotation of said plastic drive cam disk to slidingly displace said plastic spring piston during opening of a door;

a spring being mounted in said plastic housing and being disposed to be in contact with said plastic spring piston;

said spring being configured and disposed to produce a force to slidingly displace said plastic spring piston during closing of a door;

a plastic damping piston consisting essentially of a plastic material and being slidingly disposed in said plastic housing;

a second plastic pressure roller consisting essentially of a plastic material and being disposed between said plastic drive cam disk and said plastic damping piston;

said second plastic pressure roller being configured to rotate upon rotation of said plastic drive cam disk to slidingly displace said plastic damping piston;

damping fluid being configured to damp movement of said door closer;

at least one of: said plastic spring piston and said plastic damping piston being disposed in said plastic housing adjacent to said plastic drive cam disk to provide at least two chambers for containing said damping fluid in said plastic housing;

at least one of: said plastic spring piston and said plastic damping piston being configured to permit flow of said damping fluid between said at least two chambers of said plastic housing; and said plastic housing, said plastic drive cam disk, said plastic spring piston, said plastic damping piston, said plastic output shaft, and said first and second plastic pressure rollers each being configured to exhibit at least substantially the same thermal expansion coefficient.

2. The door closer according to claim 1, wherein:

said door closer comprises one of:

a floor-mounted door closer;

a frame-mounted door closer;

an internal, concealed, door-mounted door closer being configured to be disposed and concealed within a door; and a door closer comprising a plastic connecting arrangement consisting essentially of a plastic material and configured to operatively connect said plastic output shaft to a door, said connecting arrangement comprises one of: a scissors-type linkage and a slide rail arrangement;

each of said plastic spring piston and said plastic damping piston comprises one of:

an oval cross section;

a circular cross section;

a rectangular cross section; and a square cross section; and at least one of said plastic materials is reinforced with one of: glass fibers and carbon fibers.

3. The door closer according to claim 2, including at least one of (A.) and (B.), wherein (A.) and (B.) comprise:

(A.) said plastic damping piston comprises a check valve; and said check valve is molded with said plastic damping piston and said check valve and said plastic damping piston together comprise a molded, one-piece structure; and (B.) said plastic spring piston comprises a check valve; and said check valve is molded into said plastic spring piston and said check valve and said plastic spring piston together comprise a molded, one-piece structure.

4. The door closer according to claim 3, said plastic housing comprises fastening devices configured to permit fastening of said door closer to a door or a building structure;

said fastening devices and said plastic housing together comprise a molded, one-piece structure;

said plastic housing comprises channels and valves to control transfer of damping fluid and borings;

said plastic housing, said channels, said valves, and said borings together comprise a molded, one-piece structure having finished surfaces;

each of said pistons comprises channels and valves to control transfer of damping fluid and borings; and each of said pistons and its corresponding channels, valves, and borings together comprise a molded, one-piece structure having finished surfaces.

5. The door closer according to claim 3, wherein:

said plastic housing comprises a plurality of segments;

said segments comprise molded lugs and depressions which correspond to said molded lugs to connect said segments to each other to form said plastic housing;

said segments are connected to one another by one of:
glue;
an ultrasonic weld; and
a laser weld;

said plastic housing comprises end caps disposed at opposite ends of said plastic housing;

said end caps are connected to said plastic housing by one of:
glue;
an ultrasonic weld; and
a laser weld;

at least one of said segments comprises a fastening device configured to permit fastening of said door closer to a door or a building structure;

said fastening device and its corresponding segment together comprise a molded, one-piece structure;

at least one of said segments comprises channels and valves to control transfer of damping fluid;

said channels and said valves and their corresponding segment together comprise a molded, one-piece structure having finished surfaces;

at least one of said segments comprises a boring;

said boring and its corresponding segment together comprise a molded, one-piece structure having finished surfaces;

each of said pistons comprises channels and valves to control transfer of damping fluid and borings; and each of said pistons and its corresponding channels, valves, and borings together comprise a molded, one-piece structure having finished surfaces.

6. A door closer to close a door, said door closer comprising:

a plastic housing consisting essentially of a plastic material;

a plastic pinion consisting essentially of a plastic material and being rotatably disposed in said plastic housing;

a plastic output shaft consisting essentially of a plastic material and being disposed to project out a distance from said plastic housing;

said plastic pinion being connected to said plastic output shaft to permit transfer of force between said plastic pinion and said plastic output shaft;

said plastic output shaft being configured to be operatively connected to a door to permit transfer of force between said plastic output shaft and a door;

a plastic piston consisting essentially of a plastic material and being slidingly disposed in said plastic housing;

said plastic piston comprising an internal gearing;

said plastic pinion being configured and disposed to engage with said internal gearing of said plastic piston to slidingly displace said plastic piston during opening of a door;

a spring being mounted in said plastic housing and connected to said plastic piston to produce a force to slidingly displace said plastic piston during closing of a door;

damping fluid being configured to damp movement of said door closer;

said plastic piston being disposed in said plastic housing to divide said plastic housing into at least two chambers for containing said damping fluid in said plastic housing;

said plastic piston being configured to permit flow of said damping fluid between said at least two chambers of said plastic housing; and said plastic housing, said plastic pinion, said plastic piston, and said plastic output shaft each being configured to exhibit at least substantially the same thermal expansion coefficient.

7. The door closer according to claim 6, wherein:

said door closer comprises one of:
a floor-mounted door closer;
a frame-mounted door closer;
an internal, concealed, door-mounted door closer being configured to be disposed and concealed within a door; and
a door closer comprising a plastic connecting arrangement consisting essentially of a plastic material and configured to operatively connect said plastic output shaft to a door, said connecting arrangement comprises one of: a scissors-type linkage and a slide rail arrangement; and said plastic piston comprises one of:
an oval cross section;
a circular cross section;
a rectangular cross section; and
a square cross section.

8. The door closer according to claim 7, wherein:

at least one of said plastic materials is reinforced with one of: glass fibers and carbon fibers;

said plastic piston comprises a check valve; and said check valve is molded into said plastic piston and said check valve and said plastic piston together comprise a molded, one-piece structure.

9. The door closer according to claim 8, wherein:

said plastic housing comprises fastening devices configured to permit fastening of said door closer to a door or a building structure;

said fastening devices and said plastic housing together comprise a molded, one-piece structure;

said plastic housing comprises channels and valves to control transfer of damping fluid and borings;

said plastic housing, said channels, said valves, and said borings together comprise a molded, one-piece structure having finished surfaces;

said plastic piston comprises channels and valves to control transfer of damping fluid and borings;

said plastic piston and its corresponding channels, valves, and borings together comprise a molded, one-piece structure having finished surfaces;

said internal gearing formation comprises gear teeth of different sizes with different moduli; and said plastic pinion has matching gear teeth complementary with said gear teeth of said internal gearing formation.

10. The door closer according to claim 8, wherein:

said plastic housing comprises a plurality of segments;

said segments comprise molded lugs and depressions which correspond to said molded lugs to connect said segments to each other to form said plastic housing;

said segments are connected to one another by one of:
glue;
an ultrasonic weld; and
a laser weld;

said plastic housing comprises end caps disposed at opposite ends of said plastic housing;

said end caps are connected to said plastic housing by one of:
glue;
an ultrasonic weld; and
a laser weld;

at least one of said segments comprises a fastening device configured to permit fastening of said door closer to a door or a building structure;

said fastening device and its corresponding segment together comprise a molded, one-piece structure;

at least one of said segments comprises channels and valves to control transfer of damping fluid;

said channels and said valves and their corresponding segment together comprise a molded, one-piece structure having finished surfaces;

at least one of said segments comprises a boring;

said boring and its corresponding segment together comprise a molded, one-piece structure having finished surfaces;

said plastic piston comprises channels and valves to control transfer of damping fluid and borings;

said plastic piston and its corresponding channels, valves, and borings together comprise a molded, one-piece structure having finished surfaces;

said internal gearing formation comprises gear teeth of different sizes with different moduli; and said plastic pinion has matching gear teeth complementary with said gear teeth of said internal gearing formation.

11. A door closer to close a door, said door closer comprising:

a plastic housing being formed from a plastic material;

a plastic drive cam disk being formed from a plastic material and being rotatably disposed in said plastic housing;

a plastic output shaft being formed from a plastic material and being disposed to project out a distance from said plastic housing;

said plastic drive cam disk being connected to said plastic output shaft to permit transfer of force between said plastic drive cam disk and said plastic output shaft;

said plastic output shaft being configured to be operatively connected to a door to permit transfer of force between said plastic output shaft and a door;

a plastic spring piston being formed from a plastic material and being slidingly disposed in said plastic housing;

a first plastic pressure roller being formed from a plastic material and being disposed between said plastic drive cam disk and said plastic spring piston;

said first plastic pressure roller being configured and disposed to rotate upon rotation of said plastic drive cam disk to slidingly displace said plastic spring piston during opening of a door;

a spring being mounted in said plastic housing and being disposed to be in contact with said plastic spring piston;

said spring being configured and disposed to produce a force to slidingly displace said plastic spring piston during closing of a door;

a plastic damping piston being formed from a plastic material and being slidingly disposed in said plastic housing;

a second plastic pressure roller being formed from a plastic material and being disposed between said plastic drive cam disk and said plastic damping piston;

said second plastic pressure roller being configured to rotate upon rotation of said plastic drive cam disk to slidingly displace said plastic damping piston;

at least one of: said plastic spring piston and said plastic damping piston being disposed in said plastic housing adjacent to said plastic drive cam disk to provide at least two chambers in said plastic housing;

said at least two chambers being configured to contain damping fluid to damp movement of said door closer;

at least one of: said plastic spring piston and said plastic damping piston being configured to permit flow of damping fluid between said at least two chambers of said plastic housing; and said plastic housing, said plastic drive cam disk, said plastic spring piston, said plastic damping piston, said plastic output shaft, and said first and second plastic pressure rollers each being configured to exhibit at least substantially the same thermal expansion coefficient.

12. The door closer according to claim 11, wherein:

said door closer comprises one of:
a floor-mounted door closer;
a frame-mounted door closer;
an internal, concealed, door-mounted door closer being configured to be disposed and concealed within a door; and
a door closer comprising a plastic connecting arrangement formed from a plastic material and configured to operatively connect said plastic output shaft to a door, said connecting arrangement comprises one of: a scissors-type linkage and a slide rail arrangement;

each of said plastic spring piston and said plastic damping piston comprises one of:
an oval cross section;
a circular cross section;
a rectangular cross section; and
a square cross section; and at least one of said plastic materials is reinforced with one of: glass-fibers and carbon fibers.

13. The door closer according to claim 12, including at least one of (A.) and (B.), wherein (A.) and (B.) comprise:

(A.) said plastic damping piston comprises a check valve; and
said check valve is molded with said plastic damping piston and said check valve and said plastic damping piston together comprise a molded, one-piece structure; and (B.) said plastic spring piston comprises a check valve; and
said check valve is molded into said plastic spring piston and said check valve and said plastic spring piston together comprise a molded, one-piece structure.

14. The door closer according to claim 13, said plastic housing comprises fastening devices configured to permit fastening of said door closer to a door or a building structure;

said fastening devices and said plastic housing together comprise a molded, one-piece structure;

said plastic housing comprises channels and valves to control transfer of damping fluid and borings;

said plastic housing, said channels, said valves, and said borings together comprise a molded, one-piece structure having finished surfaces;

each of said pistons comprises channels and valves to control transfer of damping fluid and borings; and each of said pistons and its corresponding channels, valves, and borings together comprise a molded, one-piece structure having finished surfaces.

15. The door closer according to claim 13, wherein:

said plastic housing comprises a plurality of segments;

said segments comprise molded lugs and depressions which correspond to said molded lugs to connect said segments to each other to form said plastic housing;

said segments are connected to one another by one of:
glue;
an ultrasonic weld; and
a laser weld;

said plastic housing comprises end caps disposed at opposite ends of said plastic housing;

said end caps are connected to said plastic housing by one of:
glue;
ultrasonic weld; and
a laser weld;

at least one of said segments comprises a fastening device configured to permit fastening of said door closer to a door or a building structure;

said fastening device and its corresponding segment together comprise a molded, one-piece structure;

at least one of said segments comprises channels and valves to control transfer of damping fluid;

said channels and said valves and their corresponding segment together comprise a molded, one-piece structure having finished surfaces;

at least one of said segments comprises a boring;

said boring and its corresponding segment together comprise a molded, one-piece structure having finished surfaces;

each of said pistons comprises channels and valves to control transfer of damping fluid and borings; and each of said pistons and its corresponding channels, valves, and borings together comprise a molded, one-piece structure having finished surfaces.

16. A door closer to close a door, said door closer comprising:

a plastic housing being formed from a plastic material;

a plastic pinion being formed from a plastic material and being rotatably disposed in said plastic housing;

a plastic output shaft being formed from a plastic material and being disposed to project out a distance from said plastic housing;

said plastic pinion being connected to said plastic output shaft to permit transfer of force between said plastic pinion and said plastic output shaft;

said plastic output shaft being configured to be operatively connected to a door to permit transfer of force between said plastic output shaft and a door;

a plastic piston being formed from a plastic material and being slidingly disposed in said plastic housing;

said plastic piston comprising an internal gearing;

said plastic pinion being configured and disposed to engage with said internal gearing of said plastic piston to slidingly displace said plastic piston during opening of a door;

a spring being mounted in said plastic housing and connected to said plastic piston to produce a force to slidingly displace said plastic piston during closing of a door;

said plastic piston being disposed in said plastic housing to divide said plastic housing into at least two chambers;

said at least two chambers being configured to contain damping fluid to damp movement of said door closer;

said plastic piston being configured to permit flow of damping fluid between said at least two chambers of said plastic housing; and said plastic housing, said plastic pinion, said plastic piston, and said plastic output shaft each being configured to exhibit at least substantially the same thermal expansion coefficient.

17. The door closer according to claim 16, wherein:

said door closer comprises one of:
a floor-mounted door closer;
a frame-mounted door closer;
an internal, concealed, door-mounted door closer being configured to be disposed and concealed within a door; and
a door closer comprising a plastic connecting arrangement formed from a plastic material and configured to operatively connect said plastic output shaft to a door, said connecting arrangement comprises one of: a scissors-type linkage and a slide rail arrangement; and said plastic piston comprises one of:
an oval cross section;
a circular cross section;
a rectangular cross section; and
a square cross section.

18. The door closer according to claim 17, wherein:

at least one of said plastic materials is reinforced with one of: glass fibers and carbon fibers;

said plastic piston comprises a check valve; and said check valve is molded into said plastic piston and said check valve and said plastic piston together comprise a molded, one-piece structure.

19. The door closer according to claim 18, wherein:

said plastic housing comprises fastening devices configured to permit fastening of said door closer to a door or a building structure;

said fastening devices and said plastic housing together comprise a molded, one-piece structure;

said plastic housing comprises channels and valves to control transfer of damping fluid and borings;

said plastic housing, said channels, said valves, and said borings together comprise a molded, one-piece structure having finished surfaces;

said plastic piston comprises channels and valves to control transfer of damping fluid and borings;

said plastic piston and its corresponding channels, valves, and borings together comprise a molded, one-piece structure having finished surfaces;

said internal gearing formation comprises gear teeth of different sizes with different moduli; and said plastic pinion has matching gear teeth complementary with said gear teeth of said internal gearing formation.

20. The door closer according to claim 18, wherein:

said plastic housing comprises a plurality of segments;

said segments comprise molded lugs and depressions which correspond to said molded lugs to connect said segments to each other to form said plastic housing;

said segments are connected to one another by one of:
glue;
an ultrasonic weld; and
a laser weld;

said plastic housing comprises end caps disposed at opposite ends of said plastic housing;

said end caps are connected to said plastic housing by one of:
glue;
an ultrasonic weld; and
a laser weld;

at least one of said segments comprises a fastening device configured to permit fastening of said door closer to a door or a building structure;

said fastening device and its corresponding segment together comprise a molded, one-piece structure;

at least one of said segments comprises channels and valves to control transfer of damping fluid;

said channels and said valves and their corresponding segment together comprise a molded, one-piece structure having finished surfaces;

at least one of said segments comprises a boring;

said boring and its corresponding segment together comprise a molded, one-piece structure having finished surfaces;

said plastic piston comprises channels and valves to control transfer of damping fluid and borings;

said plastic piston and its corresponding channels, valves, and borings together comprise a molded, one-piece structure having finished surfaces;

said internal gearing formation comprises gear teeth of different sizes with different moduli; and said plastic pinion has matching gear teeth complementary with said gear teeth of said internal gearing formation.

* * * * *